US010190768B2

(12) United States Patent
Shirai et al.

(10) Patent No.: US 10,190,768 B2
(45) Date of Patent: Jan. 29, 2019

(54) GASIFICATION MELTING FACILITY

(71) Applicant: MITSUBISHI HEAVY INDUSTRIES ENVIRONMENTAL & CHEMICAL ENGINEERING CO., LTD., Yokohama-shi, Kanagawa (JP)

(72) Inventors: Toshimasa Shirai, Yokohama (JP); Norio Yoshimitsu, Yokohama (JP); Yoshihisa Saito, Yokohama (JP); Keiichi Hayashi, Yokohama (JP)

(73) Assignee: MITSUBISHI HEAVY INDUSTRIES ENVIRONMENTAL & CHEMICAL ENGINEERING CO., LTD., Kanagawa (JP)

( * ) Notice: Subject to any disclaimer, the term of this patent is extended or adjusted under 35 U.S.C. 154(b) by 362 days.

(21) Appl. No.: 15/114,832

(22) PCT Filed: Jan. 26, 2015

(86) PCT No.: PCT/JP2015/051986
§ 371 (c)(1),
(2) Date: Jul. 27, 2016

(87) PCT Pub. No.: WO2015/115354
PCT Pub. Date: Aug. 6, 2015

(65) Prior Publication Data

US 2016/0348903 A1 Dec. 1, 2016

(30) Foreign Application Priority Data

Jan. 29, 2014 (JP) ..... 2014-014579

(51) Int. Cl.
*F23G 5/00* (2006.01)
*F23G 5/027* (2006.01)
(Continued)

(52) U.S. Cl.
CPC ..... *F23G 5/006* (2013.01); *F23C 10/24* (2013.01); *F23G 5/027* (2013.01); *F23G 5/30* (2013.01);
(Continued)

(58) Field of Classification Search
CPC . F23G 5/006; F23G 5/027; F23G 5/30; F23G 5/38; F23G 2201/304;
(Continued)

(56) References Cited

U.S. PATENT DOCUMENTS 2,869,519 A * 1/1959 Schroedter ..... F23C 3/008 122/478
5,584,255 A * 12/1996 Bishop ..... C03B 5/005 110/235
(Continued)

FOREIGN PATENT DOCUMENTS

EP 3091284 A1 * 11/2016 ..... F23G 5/027
EP 3091284 A4 * 3/2017 ..... F23G 5/027
(Continued)

OTHER PUBLICATIONS

International Search Report in PCT Application No. PCT/JP2015/051986, dated Apr. 21, 2015.
(Continued)

*Primary Examiner* — Stephen M Gravini
(74) *Attorney, Agent, or Firm* — Kanesaka Berner and Partners LLP

(57) ABSTRACT

A gasification melting facility comprises: a fluidized bed gasification furnace that generates pyrolysis gas by thermally decomposing waste and discharges incombustibles; a melting furnace into which the pyrolysis gas is fed; a pyrolysis gas passage that connects the fluidized bed gasification furnace and the melting furnace; a grinder that grinds the incombustibles discharged from the fluidized bed
(Continued)

gasification furnace by passing the incombustibles through a plurality of rods; a vibratory sifter that screens the incombustibles ground in the grinder; a fixed amount feeder that feeds at a fixed amount the incombustibles that pass through the vibratory sifter, the fixed amount feeder including a plurality of transfer chambers rotatable between a position to receive the incombustibles from the vibratory sifter and a position to discharge the incombustibles; and an airflow conveyor that conveys the fixed amount of the incombustibles from the fixed amount feeder together with airflow.

5 Claims, 5 Drawing Sheets

(51) Int. Cl.

| | |
|---|---|
| ***F23G 5/30*** | (2006.01) |
| ***F23G 5/38*** | (2006.01) |
| ***F23C 10/24*** | (2006.01) |
| ***F23J 1/00*** | (2006.01) |

(52) U.S. Cl.
CPC ..... *F23G 5/38* (2013.01); *F23J 1/00* (2013.01); *F23G 2201/304* (2013.01); *F23G 2202/104* (2013.01); *F23G 2203/502* (2013.01); *F23G 2900/50203* (2013.01); *F23J 2900/01001* (2013.01)

(58) Field of Classification Search
CPC ..... F23G 2203/502; F23G 2900/50203; F23C 10/24; F23J 1/00; F23J 2900/01001
USPC ..... 110/229
See application file for complete search history.

(56) References Cited

U.S. PATENT DOCUMENTS

| | | | | |
|---|---|---|---|---|
| 5,862,762 | A * | 1/1999 | Sekiguchi | B03B 9/06 110/204 |
| 8,393,558 | B2 * | 3/2013 | Gitschel | B03B 9/06 241/19 |
| 10,047,953 | B2 * | 8/2018 | Sato | F23G 5/027 |
| 2013/0319300 | A1 * | 12/2013 | Sato | F23G 5/027 110/232 |
| 2016/0348903 | A1 * | 12/2016 | Shirai | F23G 5/027 |

FOREIGN PATENT DOCUMENTS

| | | | | |
|---|---|---|---|---|
| JP | 61-105018 | A | 5/1986 | |
| JP | 7-308650 | A | 11/1995 | |
| JP | 9-236223 | A | 9/1997 | |
| JP | 11-173521 | A | 6/1999 | |
| JP | 2000-88220 | A | 3/2000 | |
| JP | 2001-153324 | A | 6/2001 | |
| JP | 2003-71405 | A | 3/2003 | |
| JP | 3909514 | B2 | 4/2007 | |
| JP | 2008-69984 | A | 3/2008 | |
| WO | 2004/092649 | A1 | 10/2004 | |
| WO | 2012/137307 | A1 | 10/2012 | |
| WO | WO 2015115354 | A1 * | 8/2015 | F23G 5/027 |

OTHER PUBLICATIONS

Written Opinion in PCT Application No. PCT/JP2015/051986, dated Apr. 21, 2015.
Extended European Search Report in EP Application No. 15744022.3, dated Feb. 8, 2017.

* cited by examiner

GASIFICATION MELTING FACILITY

TECHNICAL FIELD

The present invention relates to a gasification melting facility that gasifies and melts waste.

This application claims priority based on Japanese Patent Application No. 2014-014579 filed in Japan on Jan. 29, 2014, of which the contents are incorporated herein by reference.

BACKGROUND ART

Gasification and melting system technology with wide application to the treatment of waste such as municipal waste and also incombustible waste, burned residue, and sludge is known. Such gasification and melting systems are provided with: a gasification furnace that gasifies waste by thermally decomposing the waste; a melting furnace that combusts pyrolysis gas generated by the gasification furnace at high temperatures and converts ash contained in the gas into molten slag, the melting furnace being disposed downstream of the gasification furnace; and a secondary combustion chamber that combusts flue gas discharged from the melting furnace. To achieve the recycling, volume reduction, and detoxification of waste, gasification and melting systems allow the slag extracted from the melting furnace to be used for construction material such as road bed material. Gasification and melting systems recover waste heat from the flue gas discharged from the secondary combustion chamber to generate electricity.

A fluidized bed gasification furnace is widely used as the gasification furnace of such a gasification and melting system. At the bottom of such a fluidized bed gasification furnace is formed a fluidized bed that is a fluid medium being fluidized by the supply of combustion air. Fluidized bed gasification furnaces are devices that partially combust the waste fed to the fluidized bed and thermally decompose the waste in the fluidized bed maintained at high temperatures by combustion heat.

Additionally, fluidized bed gasification furnaces are configured to discharge sand, which is the fluid medium, and incombustibles from the bottom of the furnace. A need exists for such a gasification melting facility to be capable of volume reduction. The reduction of incombustibles, which ultimately end up as landfill, is a matter of importance. Known means of reducing the volume of incombustibles that ultimately end up as landfill include methods of recovering valuable metals such as iron and aluminum contained in the incombustibles.

Another example of means of reducing the volume of waste is a gasification melting facility described in Patent Document 1, in which the fluid medium is separated from residues at the bottom of the fluidized bed gasification furnace, and the fluid medium is recovered to be reused. The metals contained in the residues at the bottom are sorted and collected. The non-metals are reused after pollutants are removed from the surface via abrasion. Patent Document 1 also describes technology of conveying pulverized non-metals to the melting furnace via airflow.

CITATION LIST

Patent Document

Patent Document 1: WO/2012/137307

SUMMARY OF INVENTION

Technical Problem

However, the airflow conveyance of the gasification melting facility described in Patent Document 1 is unstable due to ground incombustibles, which are powdered non-metals free of valuable metals, backflowing upstream from the airflow conveyance passage.

An object of the present invention is to provide a gasification melting facility capable of reliably removing metals and having a stable airflow conveyance of ground incombustibles.

Solution to Problem

An aspect of the present invention is a gasification melting facility comprising a fluidized bed gasification furnace that generates pyrolysis gas by thermally decomposing waste and discharges incombustibles; a melting furnace into which the pyrolysis gas is fed; a pyrolysis gas passage that connects the fluidized bed gasification furnace and the melting furnace; a grinder that grinds the incombustibles discharged from the fluidized bed gasification furnace by passing the incombustibles through a plurality of rods; a vibratory sifter that screens the incombustibles ground in the grinder; a fixed amount feeder that feeds at a fixed amount the incombustibles that pass through the vibratory sifter, the fixed amount feeder including a plurality of transfer chambers rotatable between a position to receive the incombustibles from the vibratory sifter and a position to discharge the incombustibles; and an airflow conveyor that conveys the fixed amount of the incombustibles from the fixed amount feeder together with airflow to the pyrolysis gas passage.

The above-described configuration enables metals to be removed by the vibratory sifter. This is due to the metals contained in the incombustibles being flattened by the grinder, which includes the plurality of rods. Accordingly, blockage of devices and the airflow conveyor at later stages can be prevented, and the introduction of undesired metals to the melting furnace can be prevented.

By feeding a fixed amount of the incombustibles to the airflow conveyor, stable airflow conveyance is possible. In addition, because the flattened metals are removed, obstruction to the rotation of the transfer chambers, which constitutes the fixed amount feeder, can be prevented. Backflow of the ground incombustibles from the airflow conveyor can also be prevented.

The gasification melting facility described above may also have a configuration wherein a vibrating force of the grinder is such that metals contained in the incombustibles are flattened to a size at which the metals can be separated by the vibratory sifter.

This configuration can improve the metal removal efficiency at the vibratory sifter.

The gasification melting facility described above may have a configuration wherein a vibrating force of the grinder is such that a particle size of the incombustibles is greater than that of fly ash.

The gasification melting facility described above may have a configuration wherein a vibrating force of the grinder is such that 30% or less of the particles of the incombustibles have a particle size of 63 μm or less.

The gasification melting facility may have a configuration further comprising:

a classifier that classifies a fluid medium and the incombustibles discharged from the fluidized bed gasification furnace, the classifier being disposed at a stage prior to the grinder; and a separator that separates iron and aluminum from the incombustibles classified by the classifier, the separator being disposed at a stage prior to the grinder.

This configuration is capable of separating valuable metals from the incombustibles and adjusting the amount of incombustibles fed to the grinder.

Advantageous Effects of Invention

According to the present invention, metals can be reliably removed and airflow conveyance of ground incombustibles can be stabilized.

DESCRIPTION OF EMBODIMENTS

Embodiments of the present invention are described below with reference to the accompanying drawings. Embodiments of the present invention will be described below with reference to the drawings.

Figure 1:
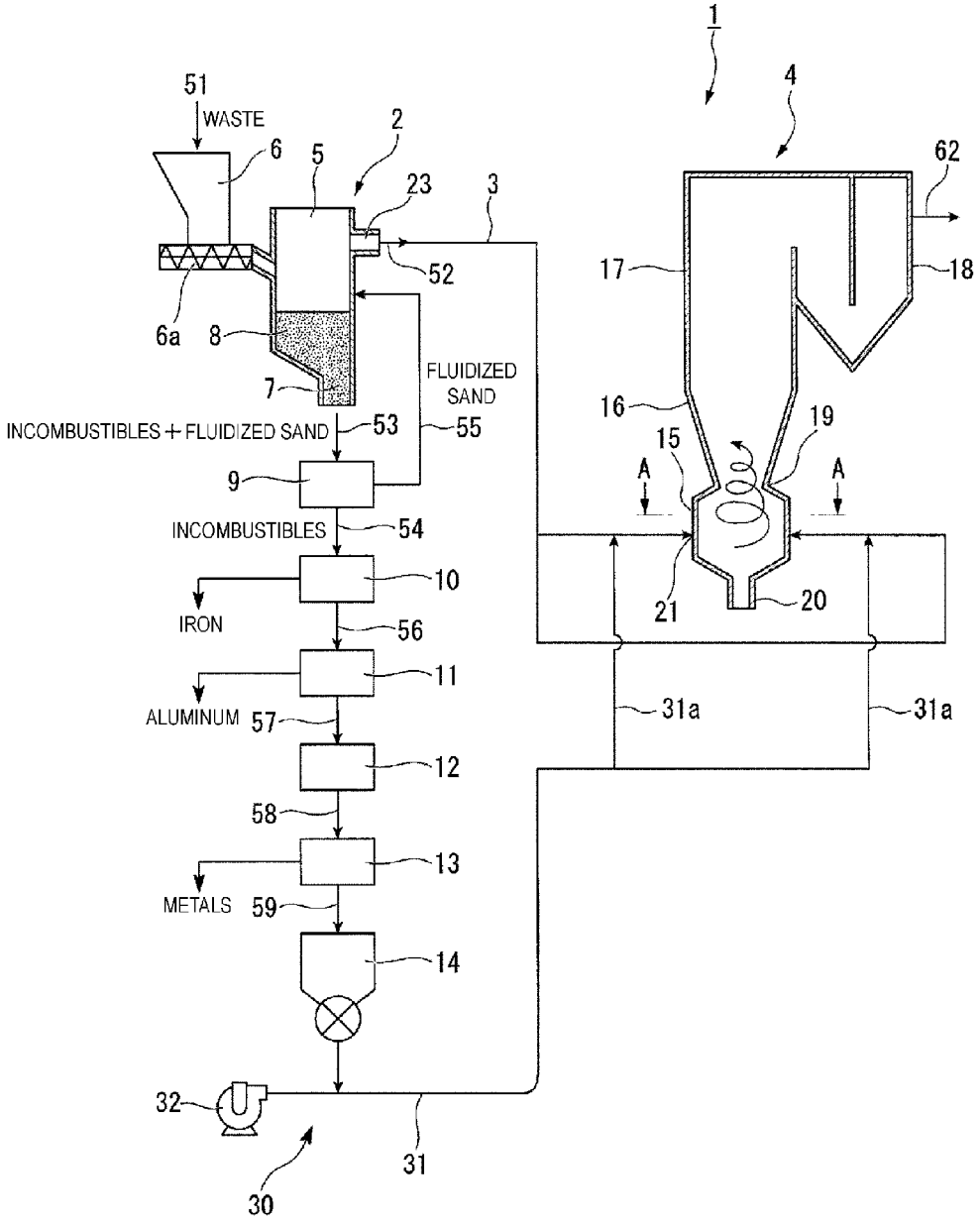
FIG. 1 is a configuration diagram of a gasification melting facility of an embodiment of the present invention.

As illustrated in FIG. 1, the gasification melting facility 1 of the present embodiment is provided with a fluidized bed gasification furnace 2, and a melting furnace 4. In the gasification melting facility 1, waste 51 is thermally decomposed in the fluidized bed gasification furnace 2, and the resulting pyrolysis gas 52 is fed to the melting furnace 4 via the pyrolysis gas passage 3.

The fluidized bed gasification furnace 2 includes a rectangular gasification furnace body 5, and a waste inlet 6 provided with a waste discharge device 6*a* disposed on a side wall of the gasification furnace body 5. A pyrolysis gas outlet 23 through which pyrolysis gas generated in the furnace is discharged is further provided at the top portion of the gasification furnace body 5. An incombustibles outlet 7 is provided at the lower portion of the gasification furnace body 5. A fluid medium 8 (fluidized sand, mainly silica sand) is circulated and supplied to the bottom portion of the fluidized bed gasification furnace 2.

The incombustibles and fluid medium 53 discharged from the incombustibles outlet 7 are fed to a sand classifier 9 where they are separated into incombustibles 54 and fluid medium 55. The fluid medium 55 thus separated is returned to the fluidized bed gasification furnace 2 via a sand circulating elevator or similar means.

The incombustibles 54 discharged from the sand classifier 9 are fed to a separator including a magnetic separator 10 and an aluminum sorter 11. First, the incombustibles 54 are fed to the magnetic separator 10 where iron is separated. The magnetic separator 10 is a separator that utilizes the magnetic attraction of a permanent magnet or an electromagnet.

In addition, incombustibles 56 discharged from the magnetic separator 10 are fed to the aluminum sorter 11 where aluminum is separated. Accordingly, valuable metals such as iron and aluminum are separated. The aluminum sorter 11 is a separator that electromagnetically induces an eddy current in the aluminum. The interaction of this eddy current with the flux gives the aluminum a deflecting force, allowing the aluminum to be separated.

Figure 2:
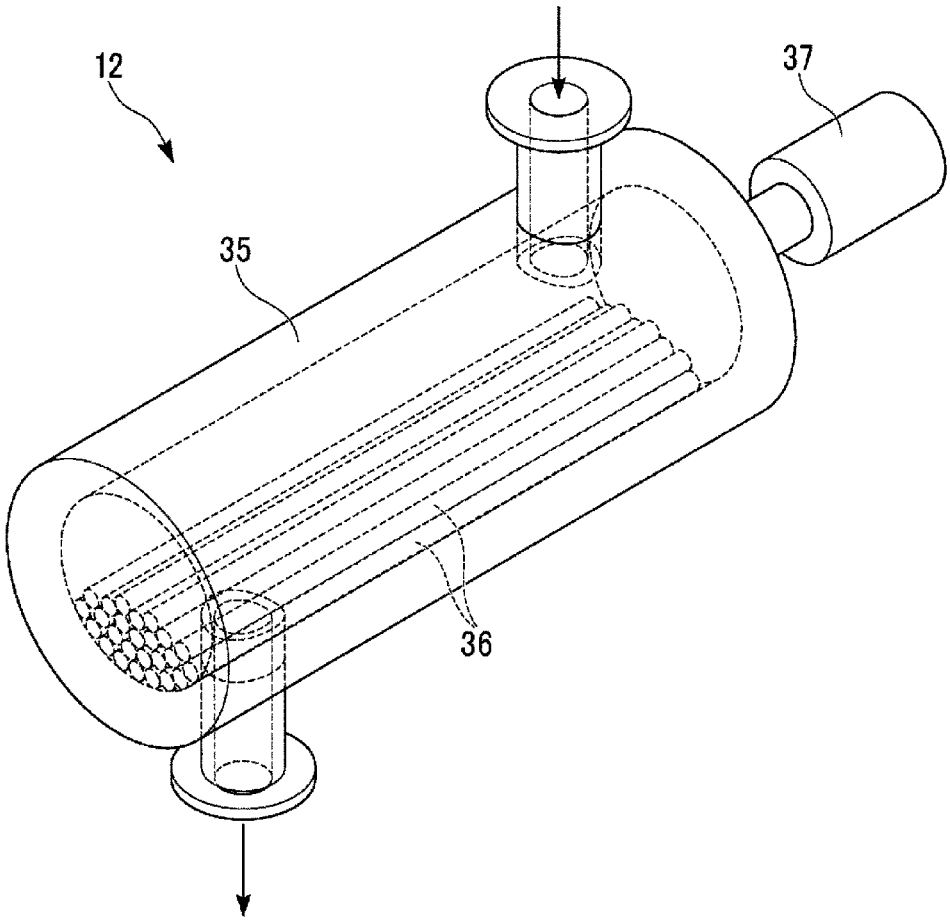
FIG. 2 is a schematic perspective view of a grinder of an embodiment of the present invention.

The incombustibles 57 discharged from the aluminum sorter 11 are fed to a grinder 12 where they are ground. As illustrated in FIG. 2, the grinder 12 is a rod mill (vibrating mill) and includes a cylindrical drum 35 with both ends closed, a plurality of rods 36 disposed in the drum 35, and a vibrator 37 that vibrates the drum 35.

The rods 36 are rod-like steel members with a circular cross section. The rods 36 are disposed aligned with the central axis of the drum 35. The grinder 12 is a device that grinds the incombustibles 57 continuously fed into the drum 35 by the force of the rods 36 hitting one another, the rods 36 being caused to move by the vibration of the drum 35.

The vibrator 37 is a vibration motor with an unbalanced weight, via which the vibrating force can be adjusted, built into the rotation shaft of the motor. The magnitude of the vibrating force can be changed by adjusting the angle of the unbalanced weight.

Figure 3:
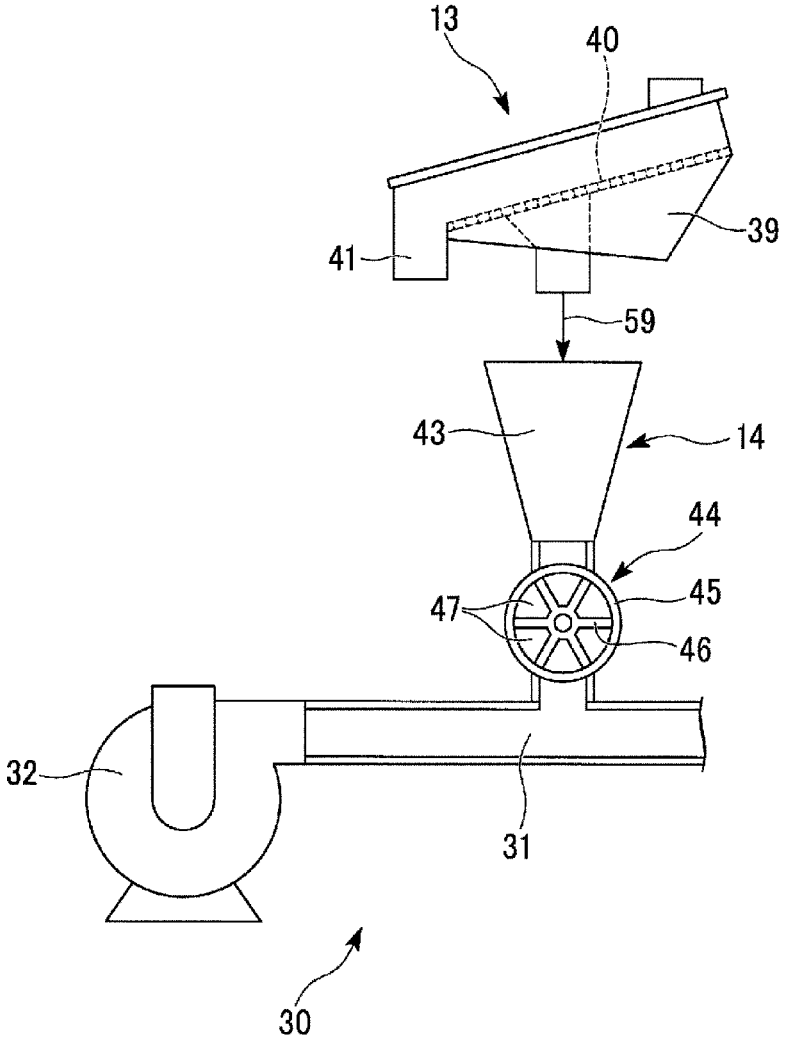
FIG. 3 is a configuration diagram of a vibratory sifter and a fixed amount feeder of an embodiment of the present invention.

As illustrated in FIG. 1, ground incombustibles 58 ground by the grinder 12 are fed to a vibratory sifter 13. As illustrated in FIG. 3, the vibratory sifter 13 includes a casing 39, and a screen 40 (sieve mesh) fixed to the casing 39 inclined at an angle. The vibratory sifter 13 is caused to vibrate by the motor and is provided with a vibrating body (not illustrated) inside the vibratory sifter 13 that oscillates vertically enabling blockage of the screen 40 to be prevented. In addition, a discharge chute 41 is provided in the casing 39 through which incombustibles that do not pass through the screen 40 are discharged. Note that the screen 40 is not required to be disposed inclined at an angle. The screen 40 may have a horizontal configuration.

As illustrated in FIG. 1, ground incombustibles 59 that pass through the screen of the vibratory sifter 13 are fed to a fixed amount feeder 14. As illustrated in FIG. 3, the fixed amount feeder 14 includes a silo 43 (hopper), and a rotary valve 44. The flow of the ground incombustibles accumulated in the silo 43 is regulated into fixed amounts by the rotary valve 44.

The rotary valve 44 includes a housing 45, and a rotor 46 that is driven to rotate within the housing 45 by a driving source (not illustrated). The housing 45 of the rotor 46 is divided into a plurality of transfer chambers 47. The rotary valve 44 of the present embodiment is provided with six transfer chambers 47. Specifically, the rotor 46 of the rotary valve 44 is provided with six vanes, resulting in the transfer chambers 47 being formed between the vanes.

Such a configuration of the rotary valve 44 allows the inlet (upper portion of the housing 45) and the outlet (lower portion of the housing 45) of the rotary valve 44 to be separated. Note that the rotary valve may not only be disposed downstream of the silo 43 but also be disposed upstream of the silo 43. Specifically, a ground incombustibles 59 backflow preventing configuration may be employed in which the ground incombustibles 59 are fed to the silo 43 via a rotary valve.

An airflow conveyor 30 is provided at the lower portion of the fixed amount feeder 14. The airflow conveyor 30 includes an airflow transport pipe 31, and a blower 32 that generates airflow in the airflow transport pipe 31. The blower 32 is located in a manner so as to allow airflow from the upstream end of the airflow transport pipe 31 toward the downstream side to be generated. As illustrated in FIG. 1, the airflow transport pipe 31 branches into two pipes at the downstream side. Both branches of the airflow transport pipe 31 are connected to the pyrolysis gas passage 3 (pyrolysis gas duct 21) described below.

Next, the melting furnace 4 will be described in detail.

The melting furnace 4 is constituted by a vertical cyclone melting furnace 15, a secondary combustion chamber 17 connected to the upper portion of the vertical cyclone melting furnace 15 via a connecting portion 16, and a boiler portion 18 connected to the downstream portion of the secondary combustion chamber 17.

The vertical cyclone melting furnace 15 has a circular cross section, and a flue gas outlet 19 having a throttling structure is provided at the top portion of the vertical cyclone melting furnace 15. In other words, the vertical cyclone melting furnace 15 has shape with a reduced diameter at the flue gas outlet 19 and a flared shape extending upward therefrom which connects to the secondary combustion chamber 17. In addition, a slag outlet 20 is provided at the lower portion of the vertical cyclone melting furnace 15.

Figure 4:
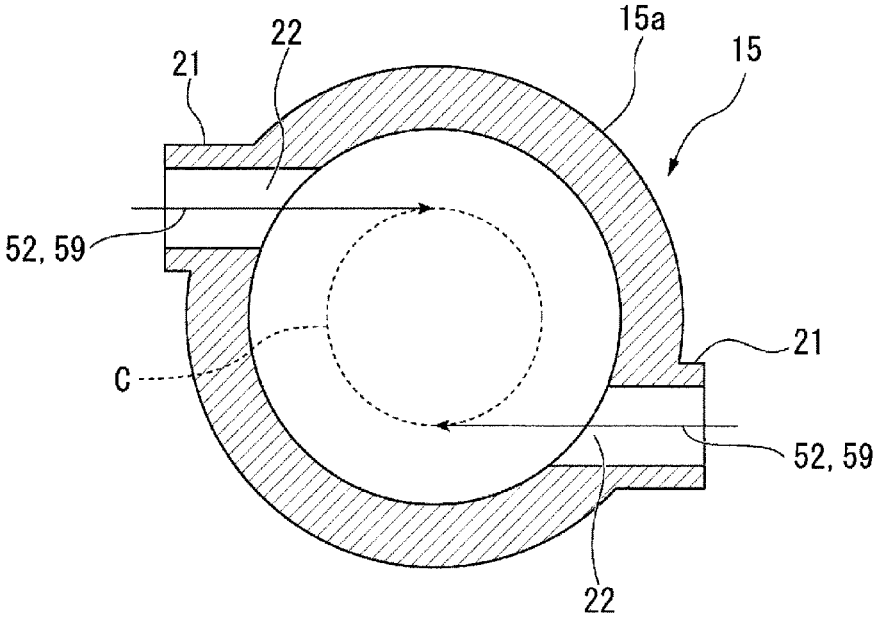
FIG. 4 is a cross-sectional view taken along A-A in FIG. 1.

As illustrated in FIG. 4, the vertical cyclone melting furnace 15 includes a substantially cylindrical furnace wall 15*a* and a pair of pyrolysis gas ducts 21 through which pyrolysis gas 52 is fed. The pyrolysis gas ducts 21 are disposed on the same horizontal plane at a predetermined position in the vertical direction of the furnace wall 15*a*. The pyrolysis gas ducts 21 are disposed in a manner such that the pyrolysis gas 52 fed from the pyrolysis gas ducts 21 is ejected in the tangential direction of circle C, which illustrates the swirl within the furnace. Furthermore, premix burners 22 are disposed at portions of the pyrolysis gas ducts 21 that are connected to the vertical cyclone melting furnace 15.

Combustion air is blown into the premix burners 22 from nozzle holes that are formed on the circumferential surfaces of the premix burners 22. Air, oxygen, oxygen-enriched air, or the like may be used as the combustion air. In this case, the air ratio of the combustion air may be in the range of 0.9 to 1.1, and preferably about 1.0. By setting the air ratio to such a value, the temperature inside the furnace can be stably maintained at high temperatures.

Since the pyrolysis gas 52 and the combustion air are blown into the vertical cyclone melting furnace 15 after being mixed with each other in the premix burners 22 in advance in this way, the pyrolysis gas 52 and the combustion air are sufficiently mixed with each other. Accordingly, the pyrolysis gas 52 can be combusted instantly in the furnace.

The secondary combustion chamber 17 is formed with a rectangular cross section. The secondary combustion chamber 17 is provided with a connecting portion 16 at the lower end portion. The connecting portion 16 reduces in diameter toward the flue gas outlet 19 of the vertical cyclone melting furnace 15. The boiler portion 18 is provided on the flue gas-downstream portion of the secondary combustion chamber 17, and heat is recovered by a superheater (not illustrated) or the like disposed on a flue. Flue gas 62, which has passed through the boiler portion 18, passes through a reaction dust collector, a catalytic reaction device, and the like, which are provided at later stages, and is discharged to the atmosphere through a chimney.

Next, the pyrolysis gas passage 3 which connects the fluidized bed gasification furnace 2 and the vertical cyclone melting furnace 15 will be described in detail.

As described above, the pyrolysis gas 52 is fed to the vertical cyclone melting furnace 15 via the pyrolysis gas passage 3. Specifically, the pyrolysis gas outlet 23 of the fluidized bed gasification furnace 2 and the pyrolysis gas ducts 21 of the vertical cyclone melting furnace 15 are connected via the pyrolysis gas passage 3. The pyrolysis gas passage 3 branches in two at a predetermined position leading from upstream (fluidized bed gasification furnace 2 side) toward downstream (vertical cyclone melting furnace 15 side). The branched pyrolysis gas passages 3, 3 connect to the pair of pyrolysis gas ducts 21.

As described above, the two branched airflow transport pipes 31*a*, 31*a* are connected to the two branched pyrolysis gas passages 3, 3. Accordingly, both pyrolysis gas 52 and ground incombustibles 59 are fed into the vertical cyclone melting furnace 15.

Note that the pyrolysis gas passage 3 and the airflow transport pipe 31 need not necessarily be branched at the downstream side. The pyrolysis gas passage 3 and the airflow transport pipe 31 may be unbranched, and pyrolysis gas 52 and ground incombustibles 59 may be fed into the vertical cyclone melting furnace 15 from a single pyrolysis gas duct 21.

Alternatively, the fluidized bed gasification furnace 2 may be provided with a plurality of pyrolysis gas passages 3 so that the pyrolysis gas 52 may be fed into a plurality of the vertical cyclone melting furnaces 15 from the single fluidized bed gasification furnace 2.

Next, the function of the gasification melting facility 1 of the present embodiment will be described.

Waste 51 fed from the waste inlet 6 is fed at a fixed amount to the fluidized bed gasification furnace 2 by the waste discharge device 6*a*. Thereafter, the waste 51 is thermally decomposed and gasified, thus being separated in gas, tar, and char (carbide). Tar is a component that is liquid at room temperature, but is present in the form of gas in the gasification furnace. Char is gradually and finely powdered in a fluidized bed, and is fed into the melting furnace 4 as the pyrolysis gas 52 together with gas and tar.

The incombustibles discharged from the incombustibles outlet 7 of the fluidized bed gasification furnace 2 and the fluid medium 53 are fed to the sand classifier 9 where the fluid medium is classified, iron is separated at the magnetic separator 10, and aluminum is separated at the aluminum sorter 11.

Next, the incombustibles 57 are fed to the grinder 12 and ground. At this time, the metals contained in the incombustibles 57 are flattened due to their malleability and ductility.

The vibrating force of the grinder 12 is adjusted with the particle size adjustment function of the grinder 12. Specifically, the vibrating force of the grinder 12 is regulated so as to not grind the flattened metals into a powder.

In addition, the vibrating force of the grinder 12 is regulated so that the ground incombustibles 59 free of metals does not later become fly ash that can escape from the melting furnace 4.

According to the research of the present inventors, 90% of fly ash are particles with a particle size of 63 μm or less. In accordance with this finding, the vibrating force of the grinder 12 of the present embodiment is adjusted so that 30% or less of the particles of the ground incombustibles 59 have a particle size of 63 μm or less. In other words, the vibrating force of the grinder 12 is regulated so that the particle size of the ground incombustibles 59 is greater than that of fly ash.

Next, the ground incombustibles 58 are fed to the vibratory sifter 13. At the vibratory sifter 13, the flattened metals do not pass through the screen 40 and are separated. The ground incombustibles 59 such as glass, rubble that pass through the screen 40 are fed to the silo 43 of the fixed amount feeder 14 and their flow is regulated by the rotary valve 44. The ground incombustibles 59 regulated by the rotary valve 44 are fed to the airflow transport pipe 31, where they are carried by the airflow and conveyed downstream. The ground incombustibles 59 conveyed by the airflow are fed to the pyrolysis gas passage 3.

The ground incombustibles 59 fed to the pyrolysis gas passage 3 are mixed with the pyrolysis gas 52 fed from the fluidized bed gasification furnace 2. The mixture then passes through the premix burners 22 and is fed into the vertical cyclone melting furnace 15 where the mixture is turned into molten slag.

The above-described embodiment enables metals to be removed at the vibratory sifter 13. This is due to the metals contained in the ground incombustibles being flattened by the grinder 12, which includes the plurality of rods. Accordingly, blockage of devices and the airflow conveyor 30 at later stages can be prevented, and the introduction of undesired metals to the melting furnace 4 can be prevented.

By feeding a fixed amount of the ground incombustibles 59 to the airflow conveyor 30, stable conveyance via airflow is possible. In addition, because the flattened metals are removed, obstruction to the rotation of the rotor 46, which constitutes the fixed amount feeder 14, can be prevented.

By providing the rotary valve 44, backflow of the ground incombustibles 59 from the airflow conveyor 30 can be prevented.

Additionally, by adjusting the vibrating force of the grinder 12 so that the flattened metals are not ground into powder, the metal removal efficiency at the vibratory sifter 13 can be improved.

By the sand classifier 9, the magnetic separator 10, and the aluminum sorter 11 being provided, valuable metals can be separated from the incombustibles, and the amount of the incombustibles fed to the grinder 12 can be regulated.

By adjusting the vibrating force of the grinder 12 so that the ground incombustibles 59 conveyed via airflow do not escape from the melting furnace 4, an increase in fly ash can be suppressed.

Additionally, because the pyrolysis gas 52 and the ground incombustibles 59 are fed into the vertical cyclone melting furnace after passing through the premix burners 22, sufficient preheating can be achieved.

By feeding the pyrolysis gas 52 and the ground incombustibles 59 from two pyrolysis gas ducts 21, the force of the swirling gas flow in the vertical cyclone melting furnace 15 can be increased. In addition, by the flue gas outlet 19 of the vertical cyclone melting furnace 15 having a throttling structure, the ground incombustibles 59 can be prevented from carrying over in the flue gas without being caught in the vertical cyclone melting furnace 15.

Next, a modified example of the above-described embodiment of the present invention will be described.

Figure 5:
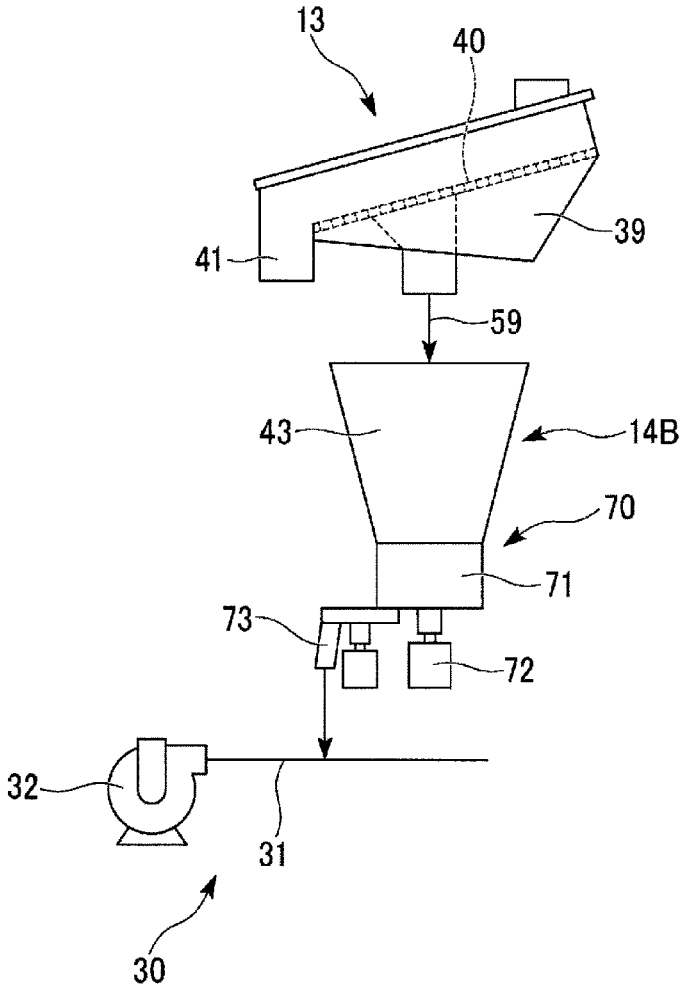
FIG. 5 is a configuration diagram of a vibratory sifter and a fixed amount feeder of another embodiment of the present invention.

As illustrated in FIG. 5, a table feeder 70 can be employed as a fixed amount feeder 14B. The table feeder 70 includes a table 71 that receives the ground incombustibles 59 from the silo 43, a drive device 72 that drives the table 71, and a chute 73 that discharges the ground incombustibles 59 from the table 71 at a fixed amount. A scraper (not illustrated) that scraps the ground incombustibles 59 is provided on the table 71.

Depending on the properties of the ground incombustibles 59 generated by the grinder 12, such a fixed amount feeder 14B may be employed.

It should be noted that the technical scope of the present invention is not limited to the embodiments described above, and various modifications may be made without deviating from the spirit of the present invention. For example, the number of branches of the pyrolysis gas passage or the number of pyrolysis gas ducts is not limited to two and may be three or more.

REFERENCE SIGNS LIST

1 Gasification melting facility
2 Fluidized bed gasification furnace
3 Pyrolysis gas passage
4 Melting furnace
9 Sand classifier (classifier)
10 Magnetic separator (separator)
11 Aluminum sorter (separator)
12 Grinder
13 Vibratory sifter
14, 14B Fixed amount feeder
15 Vertical cyclone melting furnace
19 Flue gas outlet
21 Pyrolysis gas duct
22 Premix burner
30 Airflow conveyor
31 Airflow transport pipe
32 Blower
35 Drum
36 Rod
37 Vibrator
39 Casing
40 Screen
41 Discharge chute
43 Silo
44 Rotary valve
45 Housing
46 Rotor
47 Transfer chamber
51 Waste
52 Pyrolysis gas
56, 57 Incombustibles
58, 59 Ground incombustibles (incombustibles)
70 Table feeder

The invention claimed is:

1. A gasification melting facility comprising:

a fluidized bed gasification furnace that generates pyrolysis gas by thermally decomposing waste and discharges incombustibles;

a melting furnace into which the pyrolysis gas is fed;

a pyrolysis gas passage that connects the fluidized bed gasification furnace and the melting furnace;

a grinder that grinds the incombustibles discharged from the fluidized bed gasification furnace by passing the incombustibles through a plurality of rods;

a vibratory sifter that screens the incombustibles ground by the grinder;

a fixed amount feeder that feeds at a fixed amount the incombustibles that pass through the vibratory sifter, the fixed amount feeder including a plurality of transfer chambers rotatable between a position to receive the incombustibles from the vibratory sifter and a position to discharge the incombustibles; and an airflow conveyor that conveys the fixed amount of the incombustibles from the fixed amount feeder together with airflow to the pyrolysis gas passage.

2. The gasification melting facility according to claim 1, wherein a vibrating force of the grinder is such that metals contained in the incombustibles are flattened to a size at which the metals can be separated by the vibratory sifter.

3. The gasification melting facility according to claim 1, wherein a vibrating force of the grinder is such that a particle size of the incombustibles is greater than that of fly ash.

4. The gasification melting facility according to claim 1, wherein a vibrating force of the grinder is such that 30% or less of the particles of the incombustibles have a particle size of 63 μm or less.

5. The gasification melting facility according to claim 1, further comprising:

a classifier that classifies a fluid medium and the incombustibles discharged from the fluidized bed gasification furnace, the classifier being disposed at a stage prior to the grinder; and a separator that separates iron and aluminum from the incombustibles classified by the classifier, the separator being disposed at a stage prior to the grinder.

* * * * *